United States Patent [19]

Alexander et al.

[11] Patent Number: 4,506,891

[45] Date of Patent: Mar. 26, 1985

[54] GEOMETRIC DEVICE

[76] Inventors: Adam Alexander, 57 Second Ave., New York, N.Y. 10003; Gary Piaget, 5 Ridley Ct., Glenridge, N.J. 07028

[21] Appl. No.: 362,763

[22] Filed: Mar. 29, 1982

[51] Int. Cl.[3] ..... A63F 9/08

[52] U.S. Cl. ..... 273/153 S

[58] Field of Search ..... 273/153 R, 153 S, 155

[56] References Cited

U.S. PATENT DOCUMENTS

| | | | |
|---|---|---|---|
| D. 264,361 | 5/1982 | Meffert | 273/153 S X |
| 4,051,621 | 10/1977 | Hogan . | |

FOREIGN PATENT DOCUMENTS

| | | | |
|---|---|---|---|
| 42695 | 12/1981 | European Pat. Off. | 273/153 S |
| 0072215 | 2/1983 | European Pat. Off. . | |
| 81043821 | 7/1981 | Fed. Rep. of Germany | 273/153 S |
| 170062 | 12/1977 | Hungary | 273/153 S |
| 553956 | 1/1978 | Japan . | |
| 558192 | 3/1978 | Japan . | |
| WO82/03564 | 10/1982 | PCT Int'l Appl. . | |
| 34429 | 12/1980 | Taiwan . | |
| 2084471 | 4/1982 | United Kingdom . | |
| 2101491 | 1/1983 | United Kingdom . | |

OTHER PUBLICATIONS

Buckingham Toys 1982, p. 11.

*Primary Examiner*—Anton O. Oechsle

*Attorney, Agent, or Firm*—Lewis H. Eslinger

[57] ABSTRACT

A geometric device or puzzle in the form of a great dodecahedron is provided having a plurality of surface elements movable, without disassembly, about the surface of the puzzle. The puzzle can be visualized as being made up of twelve regular pentagons each with a five-pointed star pyramid centered thereon, with each of the five arms of the star pyramids being independently mounted and belonging to yet another star pyramid. The entire surface of the puzzle is made up of these independently mounted star arms. The arms are mounted on the body to permit rotation about the center axis of symmetry of each pentagon so that rotation of the star pyramids about their respective axes of symmetry causes permutations of the star arms. By suitable rotation of the various star pyramids, many permutations of the star arm elements over the entire surfaces of the puzzle may be effected and the individual star arms can be moved about the entire surface of the puzzle without disassembly.

11 Claims, 11 Drawing Figures

GEOMETRIC DEVICE

BACKGROUND OF THE INVENTION

1. Field of the Invention

The present invention relates to a geometric device. More particularly, the present invention relates to a geometric puzzle constructed in the form of a great dodecahedron having movable surface elements that can be repositined on different faces of the great dodecahedron and in varying relationships with each other, without disassembly.

2. Prior Art

Amusement devices in the shape of three dimensional geometric solids, in the form of cubes, rectanguloids, pyramids, orbs or more sophisticated shapes, have provided challenge and entertainment for many years. These puzzle devices range from those consisting of a few pieces which can be easily assembled to those which include several pieces having intricate interlocking shapes requiring assembly in a precise order.

For example, in U.S. Pat. No. 3,461,574 there is disclosed an educational toy which includes a series of nesting polyhedra, all of different sizes and shapes and all but the smallest formed of two telescopingly interfitting numbers. In U.S. Pat. No. 3,565,422 a three-sided pyramid is disclosed which is assembled from an octahedron and four smaller pyramids. The faces of the pyramids and the octahedron have die marks thereon. The puzzle is solved by assembling the pyramid in a configuration in which the die markings on each visible face total thirteen.

In another patent of interest, U.S. Pat. No. 3,659,360, a construction set is disclosed for building a structure assembled from geometric parts having plane surfaces which may include adhesive means to interconnect the geometric parts selectively in a particular desired spatial relation. Of course, in some cases, the individual pieces may be hinged as in the polymorphic geometrical device disclosed in U.S. Pat. No. 2,992,829.

While the puzzles known in the prior art provide many hours of entertainment some do suffer from major drawbacks. When in their disassembled condition, the parts can be lost or misplaced, thereby making it impossible to complete the puzzle. Often, when partially assembled, some prior art puzzles require a high degree of manual dexterity to hold the pieces in their proper spatial orientation until other pieces locking the subgroup together are brought into position.

Recently, a cubic puzzle was introduced which had each of its six faces divided into nine discrete elements. These elements were interconnected in such a manner that any element could be moved with respect to any other element on the face; however, by doing so, the respective positions of other elements in the cube's other faces changed. The elements varied in color and the puzzle was solved when all of the elements on a face were the same color.

SUMMARY OF THE INVENTION

Purposes of the Invention

It is an object of the present invention to provide an amusement device and/or geometric puzzle which is a fascinating source of pleasure, curiosity, attention and entertainment.

It is another object of the present invention to provide an amusement device in the form of a challenging three-dimensional puzzle.

Another object of the present invention is to provide an amusement device which is appealing to the tactile and visual senses.

Still another object of the present invention is to provide an amusement device in the form of a three-dimensional solid having certain configurations formed from clusters of surface elements which are rearrangeable into different positions on the surface of the device without losing the integrity or shape of the device.

Yet another object of the present invention is to provide an amusement device in the form of a solid including means defining twelve angularly related axes of rotation about which can be rotated geometric shapes with five-fold symmetry and wherein surface elements forming the geometric shapes define twelve background faces each carrying a geometric shape formed by a cluster of the surface elements arranged on an internal structure and in which each background face is made up of sides of the surface elements on adjacent background faces, the surface elements making up a particular background face and geometric shape being changeable by selective rotational manipulation of said geometric shapes about their associated axes of symmetry.

Still other objects of the present invention in part will become obvious and in part will be apparent as the description proceeds.

BRIEF DESCRIPTION OF THE INVENTION

Generally, the above and other objects of the present invention are accomplished by providing a device in the shape of a three-dimensional solid known as a great dodecahedron formed of an assemblage of substantially congruent elements permitting rotations of subsets of these elements through specific angles, leaving the assemblage unchanged in form but permitting a permutation of some of the elements about the surface of the device.

More specifically, the device is constructed about an internal core in the shape of a dodecahedron having twelve five-sided pyramidal extensions respectively mounted on each face for rotation about axes extending perpendicularly from its associated pentagonal face of the core. A plurality of congruent surface elements are mounted between adjacent pairs of extensions for rotation with either extension. These surface elements form the surface of the great dodecahedron and define the twelve intersecting pentagonal background surfaces thereof as well as twelve geometric star shaped pyramid forms on each of the pentagonal background surfaces. Each surface element forms one arm of each of two different angularly related stars and may be rotated with either of its associated pyramid extensions and the other surface elements associated therewith.

The pyramidal extensions have arcuate edges formed thereon near their bases facing the dodecahedron core which create circular guideways about the axes of rotation. Each surface element is provided with means that engage and are retained in the circular guideways permitting the external surface element to travel along the path defined by the circular guideway when moved about a particular axis of rotation.

Selective rotation of a cluster of surface elements about one of the axes of rotation in a suitable direction and duration affects the surface elements comprising the geometric configuration and adjacent background surface.

The faces of the surface elements may be variously colored or otherwise marked. If so, the device could be transformed into a puzzle whose object is to bring all of the marked elements into some specified configuration or configurations.

The above and other objects, features and advantages of this invention will be apparent in the following detailed description of an illustrative embodiment thereof, which is to be read in connection with the accompanying drawings, wherein:

Figure 3:
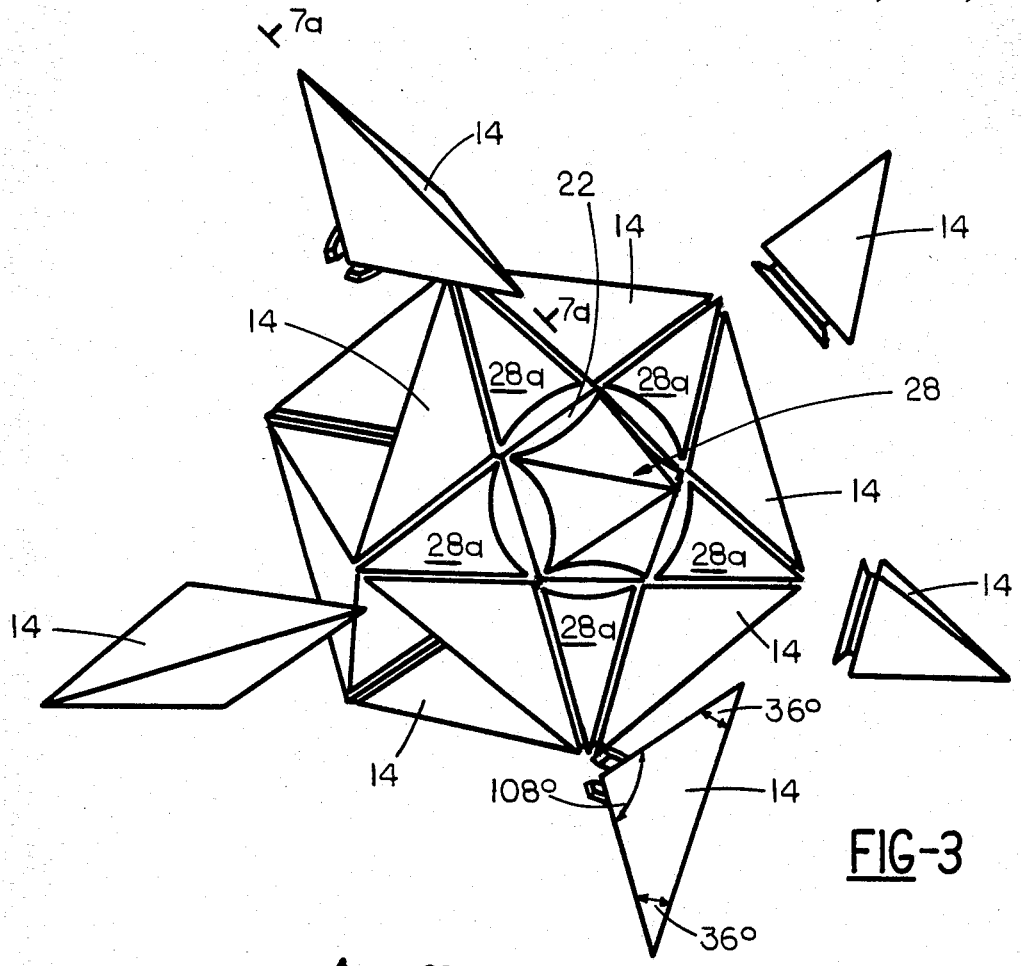
FIG. 3 is an exploded perspective view of the device of the FIG. 1 in which one cluster of surface elements has been removed to expose their associated core extension.

FIG. *7a* is a longitudinal cross-sectional view of a typical surface element of the device taken along line *7a—7a* of FIG. 3;

FIG. *7b* is a transverse cross-sectional view taken along line *7b—7b* of FIG. *7a;*

FIG. *7c* is a bottom plan view of the surface element shown in FIG. *7a;*

Figure 1:
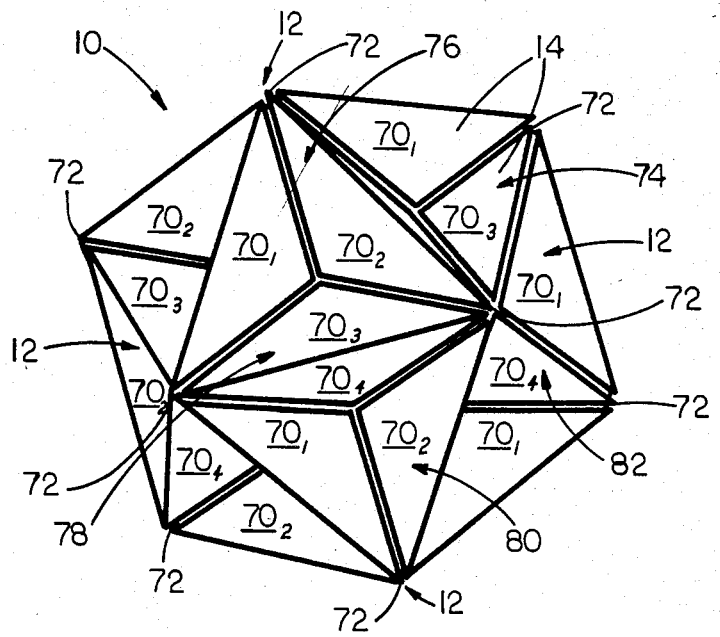
FIG. 1 is a perspective view of the geometric device or puzzle constructed in accordance with the teachings of the present invention.
Figure 8:
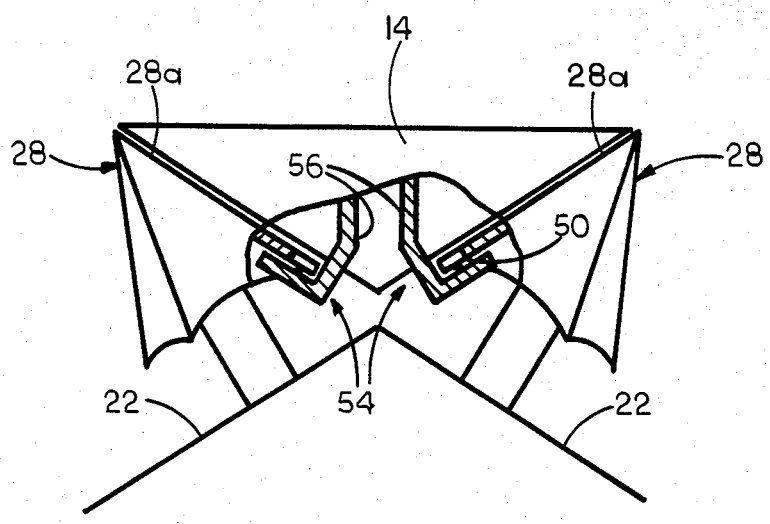
Figure 9:
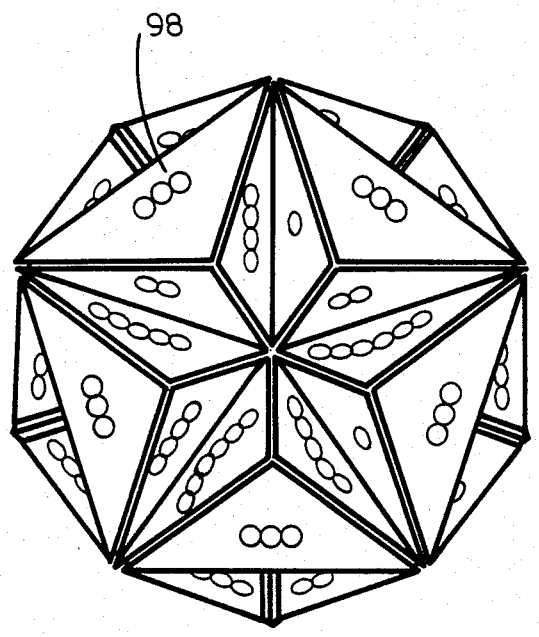

FIG. 8 is an enlarged partial elevational view, with parts broken away of a portion of the device shown in FIG. 1, showing the positioning of a typical surface element on the internal structure of the device;

FIG. 9 is a plan view of one embodiment of the device showing one method of identifying the exterior faces of the surface elements by means of die markings.

DESCRIPTION OF THE PREFERRED EMBODIMENTS

Figure 2:
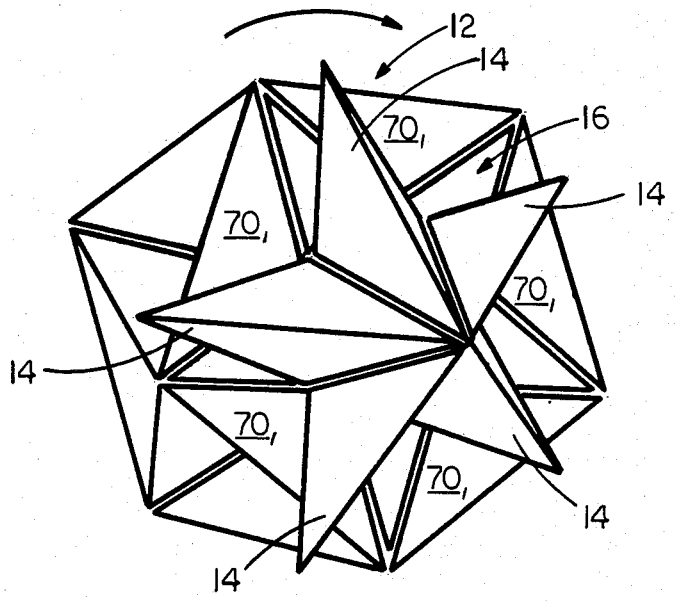
FIG. 2 is a perspective view of the device of FIG. 1 with a cluster of surface elements forming one of the geometric configurations on the device partially displaced or rotated from its normal or rest position.

Referring now to the drawings in detail, and particularly, to FIGS. 1, 2 and 3, a geometric device 10 (also referred to herein as a geometric puzzle) constructed in accordance with the present invention is shown which is in the form or shape of a great dodecahedron. The device consists of a plurality of clusters 12 formed by independent surface elements 14 mounted on an internal substructure 16 (FIG. 4).

Figure 4:
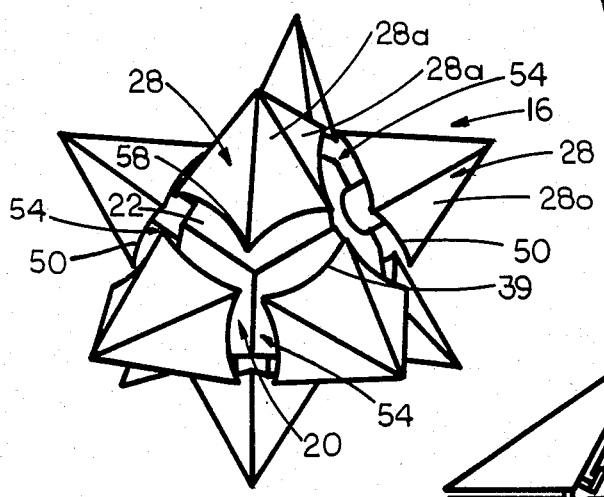
FIG. 4 is a perspective view of the device shown in FIG. 1 wherein all of the surface elements have been removed to show the internal structure in accordance with one embodiment of the present invention.
Figure 5:
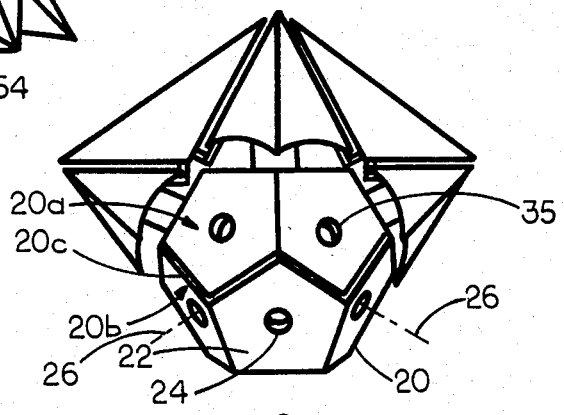
FIG. 5 is a plan view showing the device of FIG. 1 in a partially assembled condition and depicting the core, three core extensions and two surface elements engaged between the core extensions.

As can be seen best in FIGS. 4 and 5, in accordance with one embodiment of the present invention, internal structure 16 includes a hollow core member 20 in the form of a dodecahedron having twelve pentagonal shaped sides 22, not all of which are seen in the perspective view of the drawing. The core member is formed in two identical sided halves 20*a* and 20*b* joined by sonic welding or the like along line 20*c*. Each of the sides 22 has a geometric center 24 which defines an axis of rotation 26 extending perpendicularly outwardly from the side 22 and passing through this midpoint 24.

The internal substructure 16 also includes twelve five-sided pyramidal extensions 28 respectively associated with sides 22 with each being oriented perpendicularly outwardly from its associated sides 22 along their respective axes of rotation 26. The divergence of the faces 28*a* of the extensions 28 from one another is selected such that the faces lie in planes substantially parallel to the five sides 22 of the core which join with the side 22 on which the extension is mounted.

Figure 6:
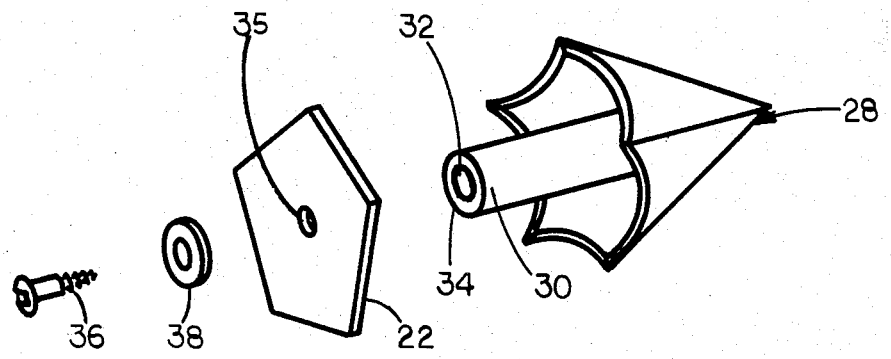
FIG. 6 is an exploded perspective view on an enlarged scale, of the details for mounting an extension to the core of the internal structure.
Figure 7A:
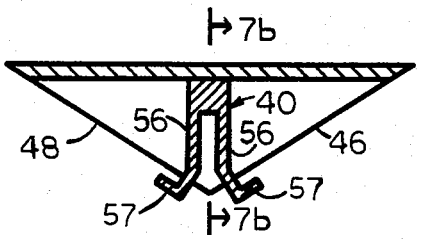
Figure 7B:
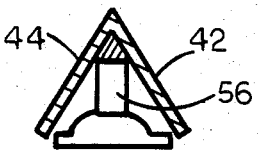
Figure 7C:
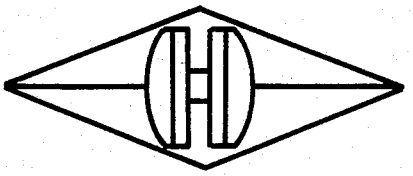

Extensions 28 are rotatably secured to their associated core side 22 as shown in detail in FIG. 6. More particularly, each extension has an integral shaft 30 having a screw hole 32 located at its free end 34. The latter is aligned with the hole 35 in its associated surface 22 and receives a screw 36 extending through a washer 38 from the inside of core 22, while the screw rotates with shaft 30 when the extension is turned. The screw head will prevent removal of extension 28 from core 22, while the washer provides a bearing surface therefor. Of course, it will be understood that extensions 28 are secured to core halves 20*a* and 20*b* before they are joined together. This arrangement permits rotation of extensions 28 while preventing inward and outward movement of the shaft with respect to the core. It will be readily apparent to those skilled in the art that other construction means may be utilized to rotatably secure extensions 28 to core member 20. Moreover, it will also be readily apparent to provide an alternative construction in which shaft 30 is fixed to the side 22 and extension 28 rotatably secured thereto. Since such rotatable mounting constructions for various uses are well-known, for the sake of brevity, they will not be detailed herein.

With all twelve of the extensions 28 in place on the twelve surfaces 22 of core member 20, the internal substructure 16 will assume the configuration shown in FIG. 4.

The external surface elements 14 are superpositioned on the internal structure 16 and rotatably secured thereto. There are thirty of these surface elements which, as best seen in FIGS. *7a, b,* and *c,* are in the shape of a tetrahedron having two angularly related side faces 42 and 44 which will always be exposed when the element is in position on internal structure 16 (and hence are referred to hereinafter as the exterior faces of the surface element). The sides of the surface elements are in the shape of an obtuse triangle whose interior angles are 108°, 36° and 36°, respectively. The two faces 46, 48 of the surface element 14, which face their associated pyramid extensions, have internal angles of 36°, 72° and 72°.

The thirty surface elements 14 are rotatably positioned on the internal structure 16 by means of circular guideways defined by the edges of 50 of pyramidal extensions 28 and by cooperating members 40 extending from the elements 14 adapted to be received in the guideways. As seen in FIGS. 4, 5, 6 and 8, the bottom edge 50 of each face 28*a* of each extension 28 is curved, the degree of curvature being selected such that a guideway 54 having an exterior circular edge defined by the edges 50 of the five adjoining extensions 54 is created in the plane of each of the core faces 22 when the extensions 28 are in position on the internal core structure 16. The cooperating attaching members on each surface element 14 are a pair of resilient attaching legs 56 at the juncture of the interior faces 46 and 48. The legs 56 have flanges 57 slidably received in the guideway 54 defined by the adjacent edges 50 of adjacent pyramidal extensions 28 between which the surface element 14 is positioned (FIG. 8). Thus, each surface element is, in effect, simultaneously positioned in two angularly related guideways. To facilitate movement of the legs 56 within guideway 54, the corners 58 on edges 50 may be rounded to reduce interference with the passage of the legs. The legs 56 are only attached to elements 14 at their upper edges and thus are resilient and can move toward and away from each other as they pass through the guideways.

When all of the surface elements 14 are positioned on the internal structure 16, between each adjacent pair of faces 28*a* of extensions 28, a solid in the form of a great dodecahedron 10 is created. The solid has twelve background surfaces 70 (distinguished by subscripts, for example, background surface 70, in FIG. 1 wherein not all of the background surfaces are seen because of the perspective view) corresponding to the twelve intersecting pentagons of a great dodecahedron. Each background surface 70 also has a cluster 12 of surface elements 14 thereon in the form of a five armed star. The center 72 of each of the stars (eight centers are seen in FIG. 1) coincides with the axis of rotation 26 of its associated pentagon extension 28, i.e. the axis of symmetry thereof. Thus, each star pyramid has five-fold symmetry on its background pentagon surface. Furthermore, the surface elements 14 which form one cluster 12 also form portions of the five background surfaces (i.e. pentagons) that intersect the pentagon on which the cluster 12 is positioned. For example, in FIG. 1, the cluster 12 is positioned on the background pentagon surface $70_1$ and includes surface elements 74, 76, 78, 80 and 82. The background surface $70_2$ is composed, in part, of one of the exterior surfaces of the surface elements 76 and 80, respectively, as well as the exterior surfaces of other surface elements forming other geometric clusters on the solid.

As described above, each surface element 14 is rotatable about either of two adjacent axes of rotation for the star pyramids of which it is part. Thus, as seen in FIG. 8, element 14 can rotate with either of its two associated extensions 28 when one of the star configurations it is in is rotated. Accordingly, when a cluster 12 of elements 14 is rotated, as seen in FIG. 2 for the cluster on background surface $70_1$, the specific elements making up any particular background surfaces, formed by some of the elements in the particular cluster 12 being rotated, are varied. By selective manipulation of the clusters in the manner depicted in FIG. 2, individual elements 14 can be moved all about the surface of the device.

While the device described above has, because of its inherent construction features and operability a certain degree of amusement and entertainment value, this value may be further enhanced by variously coloring the exterior faces 42 and 44 of the surface elements 14 or applying indicia such as die markings 98 thereon (FIG. 9). For example, each background pentagon may be made of a different color or, since there are twelve pentagons, six colors could be used, with each pair of parallel pentagons being the same color. By providing such coloration or indicia, the solid is tranformed into a challenging puzzle wherein the object would be to bring the surface elements 14 and thus the external faces into an arbitrary or pre-selected configuration or configurations and then return it to its original condition.

The degree of difficulty in "solving" the puzzle can be increased sustantially by also coloring the faces 28*a* of the pyramidal extensions to correspond to the colors of their adjacent background pentagon surfaces formed by the surface elements. Thus, the pyramidal extensions would also have to be properly positioned relative to the background surfaces for the puzzle to be "solved." If other indicia such as the die markings of FIG. 9 were used, the extensions could also be marked with such indicia.

Regarding the materials from which the device is constructed, plastic materials should be used because of the ease in which the various parts can be formed, or colored, if desired, as well as because the resultant device will be lightweight and comparatively inexpensive to manufacture.

Although an illustrative embodiment of the invention has been described herein with reference to the accompanying drawings it is to be understood that the invention is not limited to that precise embodiment, and that various other changes and modifications may be effected therein by one skilled in the art without departing from the scope or spirit of this invention.

What is claimed is:

1. A geometric device comprising:

an internal support structure in the form of a dedecahedron having pentagonal faces;

twelve angularly related rotatable extensions, each being rotatbly mounted on one of the pentagonal faces of said dodecahedron support structure and each of said extension being in the form of a five-sided pyramid having sides lying in five planes substantially parallel to the planes of the five pentagonal faces of the support structure which join the face on which the extension is mounted; and a plurality of external surface elements, each movably mounted only between an adjacent pair of said entensions for selective rotation with either of its assocaited extension, said surface elements cooperating to define discrete geometric shapes about each of said extension, so that selective rotation of said geometric shapes with their associated extensions through predetermined angles of rotation affects the elements forming adjacent geometric shapes.

2. A geometric device comprising:

an internal support structure in the form of a dodecahedron have pentagonal faces;

twelve angularly related rotatable extensions on said support structure, each of which is respectively associated with and rotatably mounted on one of the pentagonal faces of said dodecahedron support structure and said extensions being five-sided pyramids whose sides lie five planes substantially parallel to the planes of the five pentagonal faces of the support structure which join the face on which the extension is mounted; and a plurality of external surface elements in the form of a termination and movably mounted between adjacent pairs of said extension for selective rotation with either of its associated extension, with each surface element extending between two opposed faces of adjacent extension elements, said surface elements cooperating to define discrete geometric shapes about each of said extensions so that twelve raised geometric star shapes on twelve background fields in the form of a great dodecahedron are defined, and such that selective rotation of said geometric shapes with their associated extensions through predetermined angles of rotation affects the elements forming adjacent geometric shapes.

3. A geometric device comprising a plurality of surface elements and an internal core structure, said surface elements being dimensioned and arranged on said internal core structure to define the shape of a great dodecahedron and said elements comprising the arms of the geometric star shapes of the great dodecahedron; said internal core including means for permitting rotation of each geometric star shape of the great dodecahedron about its central axis.

4. A geometric device as defined in claim 3 wherein said surface elements are separate tetrahedron shaped elements, whereby one surface element forms the arm of two of said star shapes and can rotate about either of two different angularly related star shape central axis whereby rotation of said star shapes will affect movement of said elements about the surface of the device.

5. A geometric device as defined in claim 4 wherein said surface elements have coding indicia thereon.

6. A geometric device comprising a plurality of surface elements and an internal core structure, said surface elements being dimensioned and arranged on said internal core structure to define the shape of a geometric solid having a plurality of intersecting planar surfaces; each of said surface elements cooperating to define at least two of said regular geometric shapes each of which has a geometric center and at least one of said intersecting planar surfaces; said internal core structure including means for permitting rotation of said geometric shapes about their centers, and wherein each surface element is separately formed one from the other and can rotate about either of at least two different shape centers, whereby rotation of said shapes will effect movement of said elements about the surface of the device.

7. A geometric device as defined in claim 6 wherein said surface elements have coding indicia thereon.

8. A geometric device comprising a central core member in the form of a dodecahedron; said core member having planar faces; a core extension rotatbly mounted on and projecting from the geometric center of each of said faces; and a plurality of external surface elements slidably engaging selective rotatable extensions and arranged to form a solid in the form of a great dodecahedron; said external surface elements creating a star-like figure on each of said twelve background pentagon surfaces; each star-like figure being associated with one of said extensions whereby said external surface elements are rotatable with two of said extensions about angularly related axes.

9. A geometric device as defined in claim 8 including identifying indicia on the surfaces of the surface elements.

10. A geometric device as defined in claim 9 including identifying indicia on the surfaces of said extensions.

11. A shiftable element device comprising a plurality of surface elements dimensioned and arranged to define the shape of a great dodecahedron, each said surface element constituting an arm of two adjacent ones of the five-armed star shapes defining the surface of the great dodecahedron, and means maintaining said surface elements in assembled relationship and permitting each said star shape to be rotated about its central axis.

* * * * *